United States Patent [19]

Maker et al.

[11] Patent Number: 4,678,084

[45] Date of Patent: Jul. 7, 1987

[54] SHIPPING CONTAINER FOR PACKAGING ENDLESS BELTS FOR TRANSPORTATION OR STORAGE

[75] Inventors: Lewis W. Maker, Charlotte, N.C.; Horace Nicholson, Mullins, S.C.

[73] Assignee: United States Supply Company, Charlotte, N.C.

[21] Appl. No.: 810,055

[22] Filed: Dec. 17, 1985

[51] Int. Cl.[4] ..... B65D 19/00

[52] U.S. Cl. ..... 206/597; 206/599; 206/389; 206/408; 206/69; 206/511; 220/71; 220/73

[58] Field of Search ..... 206/386, 597, 599, 389, 206/391, 407, 408, 443, 69, 511, 509; 220/71, 73

[56] References Cited

U.S. PATENT DOCUMENTS

| | | | |
|---|---|---|---|
| 2,107,695 | 2/1938 | Geare | 206/46 |
| 2,127,578 | 8/1938 | Wyman | 206/46 |
| 2,885,072 | 5/1959 | Purcell | 206/59 |
| 3,196,229 | 7/1965 | Glass | 206/65 |
| 3,244,312 | 4/1966 | Lawson | 220/5 |
| 3,312,338 | 4/1967 | Uterhart | 206/408 |
| 3,539,552 | 11/1970 | Mounts et al. | 220/97 |
| 3,768,641 | 10/1973 | Jerzewski, Jr. | 206/52 R |
| 3,888,577 | 6/1975 | Meyer | 355/3 R |
| 3,942,637 | 3/1976 | Glennie | 206/389 |
| 4,079,835 | 3/1978 | Kendig | 206/416 |
| 4,132,310 | 1/1979 | Dorsch | 206/386 |
| 4,150,745 | 4/1979 | Williams et al. | 206/303 |
| 4,162,009 | 7/1979 | Schouten | 206/389 |
| 4,291,803 | 9/1981 | Perales | 206/443 |
| 4,401,217 | 8/1983 | Blatt | 206/408 |
| 4,550,830 | 11/1985 | Shoert | 206/386 |

FOREIGN PATENT DOCUMENTS

| | | | |
|---|---|---|---|
| 1062425 | 8/1963 | United Kingdom | 206/408 |

*Primary Examiner*—Joseph Man-Fu Moy

*Attorney, Agent, or Firm*—Bell, Seltzer, Park & Gibson

[57] ABSTRACT

A novel shipping container, package, and method of packaging are provided for facilitating the packaging, shipment and storage of heavy, bulky, and deformable endless belts. The shipping container includes top and bottom members which cooperatively engage each other to provide an interior hollow chamber. Interposed wall portions are provided in the bottom member which extend at an angle between the side walls and bottom wall of the bottom member. The side walls and interposed wall portions of the bottom member cooperate with portions of an endless belt positioned in the container to ensure that the belt maintains its substantially cylindrical configuration during transportation or storage in order to avoid the damaging effects to the belt which result from its collapse within a conventional container. Numerous additional features are also disclosed for enhancing the material handling characteristics of the container and, or package (which is formed from the novel container and a bulky, deformable endless belt of the type described). According to the novel method, a shipping container is provided and an endless belt positioned therein in a manner which exposes the opposing open ends of the belt to facilitate access by a mandrel for subsequent removal of the belt while lower regions of the belt are supported to prevent the collapsing of the belt within the container.

31 Claims, 15 Drawing Figures

SHIPPING CONTAINER FOR PACKAGING ENDLESS BELTS FOR TRANSPORTATION OR STORAGE

BACKGROUND OF THE INVENTION

This invention relates to a returnable shipping container and more particularly, to a container which is especially desirable for use in packaging, storing and shipping deformable endless belts that are characterized by their substantial bulk and weight. The invention also relates to a shipping package which is formed from the combination of the unique container described herein and a deformable endless belt of the type described as well as to a unique method for packaging and handling endless belts for transportation or storage.

Endless belts are utilized in a variety of industrial settings and applications. These belts may be used, for example, to drive machinery, convey goods, or to transmit motion. Many of these belts are designed for use in specialized applications where the belt possesses unique characteristics that are dictated by the functional operations they are designed to perform. For example, a particular class of belting is employed in the textile industry for mechanically pre-shrinking fabrics. In a mechanical preshrinking unit these belts are subjected to tension as well as to numerous directional changes designed to literally stretch the belt (and the cloth) in portions of the unit followed by inducing a recoiling action by relaxing the surface tension of the belt to thereby impart the pre-shrunk characteristics of the fabric. Consequently, this type of belt is made of a rubber composition with the attendant qualities of extreme bulk, deformability, and collapsibility. Moreover, these belts typically weigh in excess of 1200 pounds. As a result of the tremendous weight and bulk of these belts, they are highly susceptible to damage resulting from inadequate support and protection for the payload during storage and transportation in conventional shipping containers such as wooden crates. In some instances the degree of damage associated with conventional shipping containers may be so great as to render the belts totally unsuitable for their intended use.

A number of attempts have been previously made in an effort to overcome the shortcomings associated with conventional shipping containers in transporting endless belts. As illustrated by U.S. Pat. Nos. 2,885,072; 3,942,637; 4,150,745; and 4,162,009, however, these efforts have typically entailed wrapping the belts around cores or nesting the belts so as to provide overlapping layers. These approaches are totally unsuitable for applications where the belts are heavy and deformable since this type of orientation actually results in the formation of permanent creases in some belts such as those used in the aforementioned pre-shrinking units. As a result, the conventional practices for storing and transporting bulky and deformable endless belts, including the use of conventional shipping crates, remain prevalent nothwithstanding the substantial and associated risk of damaging the payload.

In addition to providing adequate support and protection for the endless belt, a shipping container for these products should also possess additional features for facilitating their transportation, storage, and general utility. These features include adequate strength without excessive weight, supporting projections on the container for facilitating stable stacking while providing access by forklifts, pallet jacks, and the like, and nestability of the container members for compact storage in a warehouse or to facilitate transportation of empty containers. In addition, the container should provide for relative ease of payload introduction and removal as may be achieved through the use of the novel method of packaging described herein.

It is an object of the present invention to provide a novel returnable shipping container, package, and method of packaging which avoid the drawbacks associated with conventional shipping crates and packaging methods primarily in the form of damage resulting from collapsing payloads. It is a further object of the invention to provide a shipping container possessing features which enhance the material handling characteristics of the package formed from the combination of the novel container and a belt of the type described.

SUMMARY OF THE INVENTION

As further described herein, a shipping container is provided including a top and bottom member which cooperatively engage each other to provide an interior, hollow chamber. The top member includes opposing pairs of side and end walls and a top wall. The bottom member comprises opposing pairs of side and end walls, a bottom wall, and interposed wall portions which extend at an angle between the respective side walls and bottom wall.

In addition, a plurality of spaced apart projecting members are provided which extend downwardly from the bottom wall, adjacent side walls, and the interposed wall portions of the bottom member to provide supporting feet for the container. These projecting members are constructed and arranged so as to define forklift channels for receiving the forks of a forklift truck or pallet jacks to facilitate handling of the container or assembled package.

Due to the unique cooperation between primarily the side walls and interposed wall portions of the bottom member with portions of an endless belt positioned in the container, the belt maintains its substantially cylindrical configuration during transportation and storage. Consequently, the potentially adverse effects resulting from the collapse of the belt under its own weight are avoided.

According to the novel method described herein, a shipping container is provided and a belt is positioned therein utilizing a mandrel in such a fashion that upper regions of the opposite open ends of the belt are exposed to provide for later access by a mandrel or similar means for removing the belt. In like fashion, positioning of the belt in the bottom member when forming a shipping package is facilitated by this feature since removal of the mandrel is easily accomplished. In addition, when the belt is positioned in the bottom member of the container, lower regions of the belt are supported in a manner that causes opposing lower portions of the belt to be columnized alongside opposing side walls of the bottom member to prevent collapsing of the belt. Accordingly, significant limitations in the field of packaging, storing and transporting endless belts are avoided by the use of the present invention.

IN THE DRAWINGS

Additional features and attendant advantages of the invention will be described in detail hereinbelow in connection with the drawings in which.

Figures 11, 12, 13:
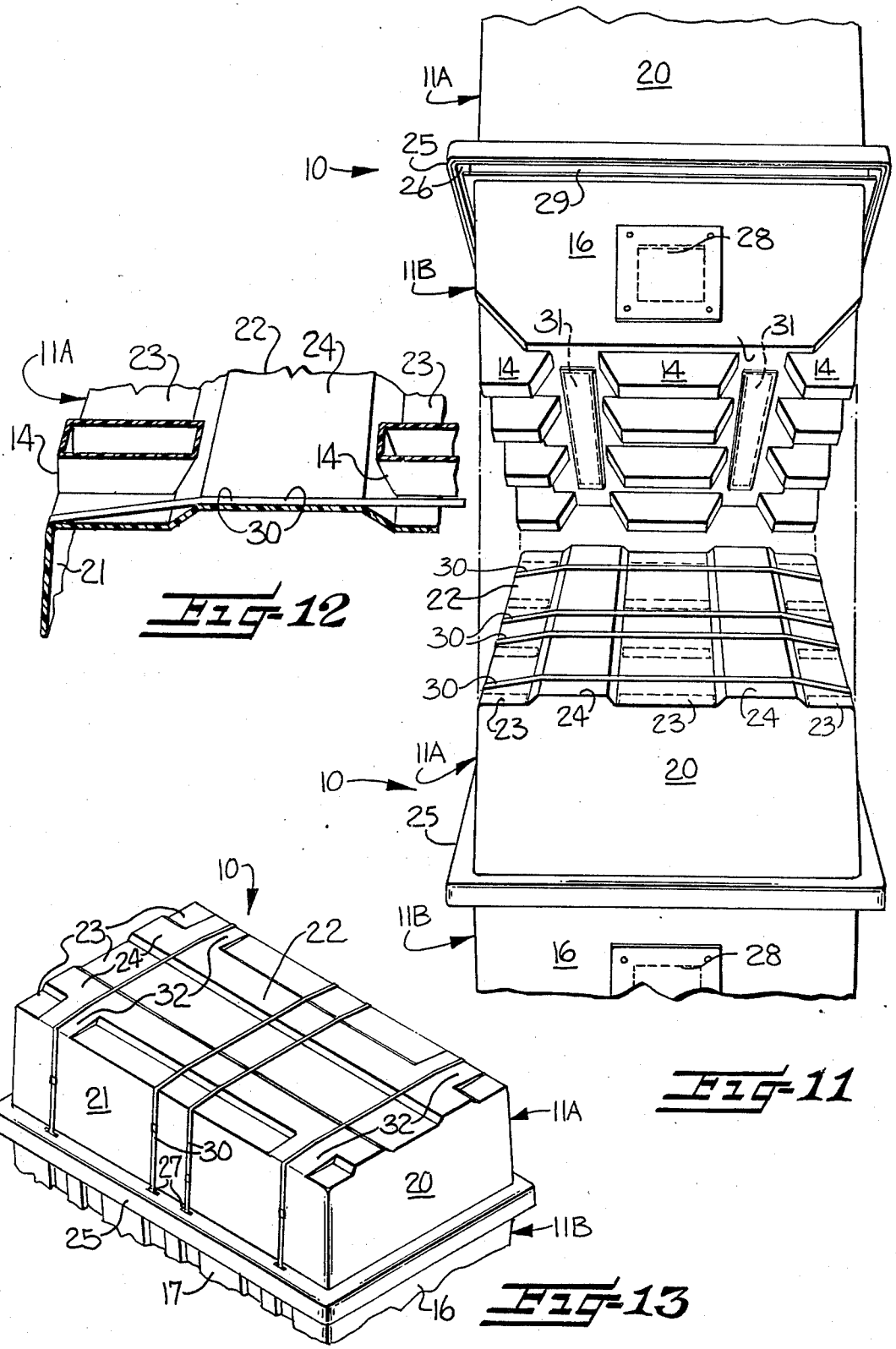
FIG. 11 is an exploded partial perspective view showing the feet provided on the bottom of one container and the recessed areas provided on the top member of a second adjacent container which is also equipped with strapping means spanning the recesses for providing abutment stops for the feet when they are received in the portions of the recessed areas shown in phantom.

FIG. 12 is a partial sectional view depicting the anti-shift relationship formed when the feet of one container are positioned within the recessed areas of an adjacently stacked container; and FIG. 13 is a partial perspective view of the container showing an alternative construction wherein the top member includes abutment stops within the recessed areas for preventing longitudinal sliding movements of one container relative to another when placed in a stack.

DETAILED DESCRIPTION

Figure 1:
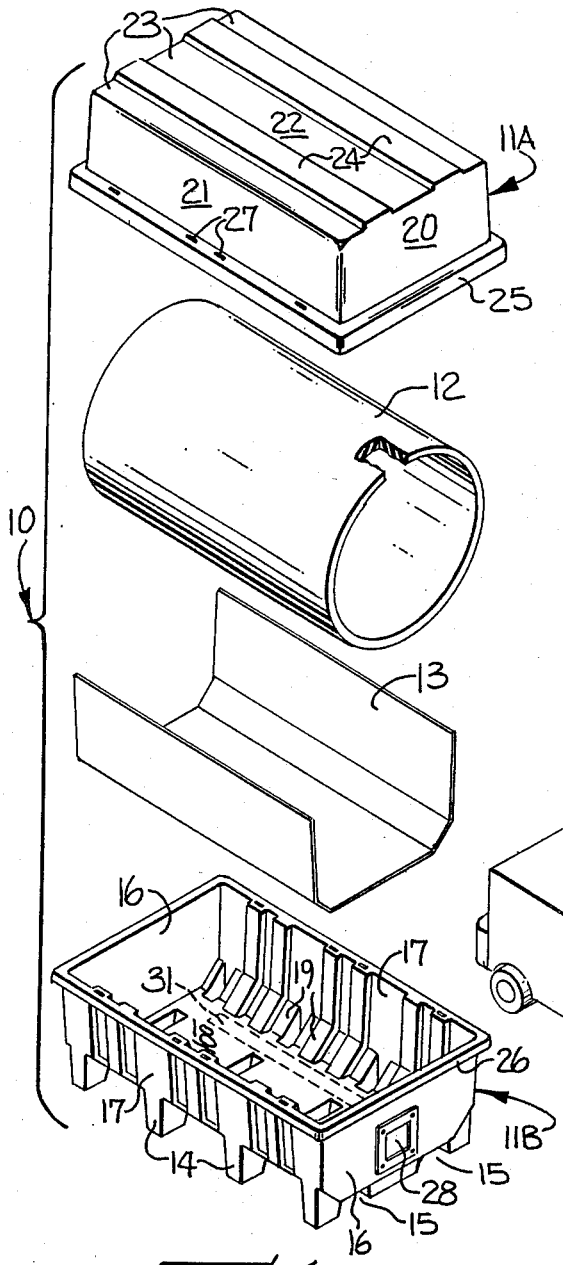
FIG. 1 is an exploded perspective view of an embodiment of a shipping package including a novel shipping container made in accordance with the present invention as well as an endless belt and an optional belt protective insert used in forming the package according to the present invention.

As shown in FIG. 1, a shipping container 11, made in accordance with the present invention, comprises a top member 11A and a bottom member 11B which cooperatively engage each other to provide an interior hollow chamber within the container 11. A shipping package 10, as described more fully below, comprises the elements of the container 11, namely the top and bottom members 11A and B respectively, as well as a deformable endless belt 12 which is positioned in the container. An optional belt protective insert 13 may be placed in the interior of bottom member 11B prior to positioning belt 12 therein to form the package 10. The shipping container 11 is molded of plastic material so as to provide a lightweight, and reusable shipping container. The overall dimensions of the container will vary according to the payload to be transported. By way of example, the container depicted in the drawings has an overall length of approximately 8 feet and an exterior width of approximately five feet (including the rims).

Bottom member 11B of the container 11 includes a pair of opposing side walls 17, a pair of end walls 16, and a bottom wall 18. Side walls 17 and bottom wall 18 are interconnected by interposed wall portions 19 which provide stabilizing support for lower portions of the endless belt 12 resting thereon as well as the belt portions extending upwardly therefrom when the belt is placed in the container. As shown in FIG. 1, side walls 17 and interposed wall portions 19 may be optionally corrugated to provide additional strength for the container while reducing the thickness of the molded walls to reduce the overall weight of the container. In that event, portions 17A of the side walls as well as portions 19A of the interposed wall portions will contact the belt and provide the requisite support therefor.

Figure 5:
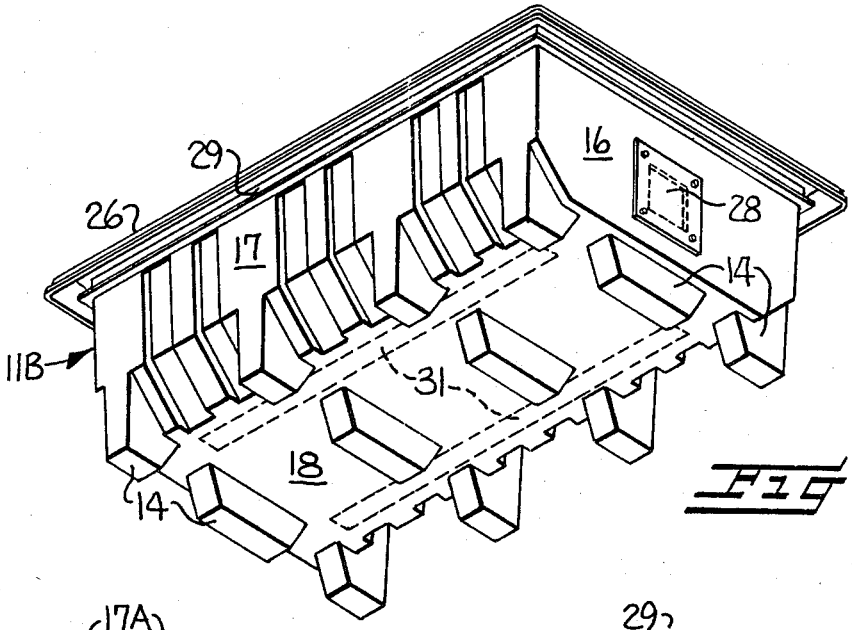
FIG. 5 is a bottom perspective view of the bottom member of the container.
Figure 6:
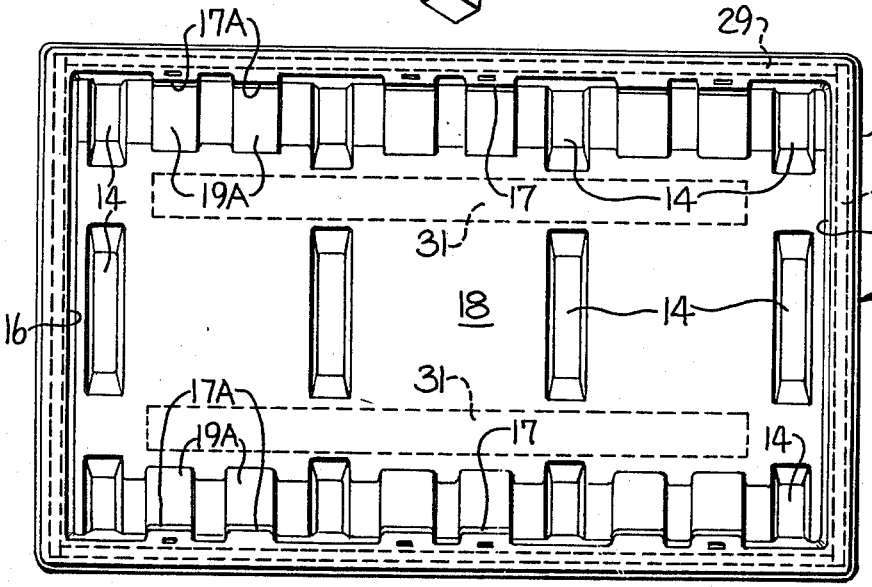
FIG. 6 is a top plan view of the interior of the bottom member of the container.

Bottom member 11B also includes a plurality of spaced apart projecting members 14 which extend downwardly from the bottom wall 18, interposed wall portions 19, and side walls 17 to define supporting feet for the container. These projecting members are preferably dimensioned and arranged to allow for stacking of the containers in one position of orientation and in a second position 180 degrees removed thereform. In addition, the projecting members are preferably arranged in a manner to define forklift channels 15 for receiving the forks of a forklift truck or pallet jacks to improve the material handling characteristics of the container. The channels 15 are preferably provided on both the ends and sides of bottom member 11B so that forklift access is provided from any of four directions. Reinforcing plates 31 (FIG. 5) may be provided in bottom member 11B to protect against accidental penetration by sharp forks through the bottom 18 in the event the container is lifted from either end (as in removing the container from a trailer) with forks that are inadequate in length. An inspection window 28 (FIG. 1) may be optionally provided as well in one of the end walls 16 in order to facilitate an inspection of the contents.

Figure 7:
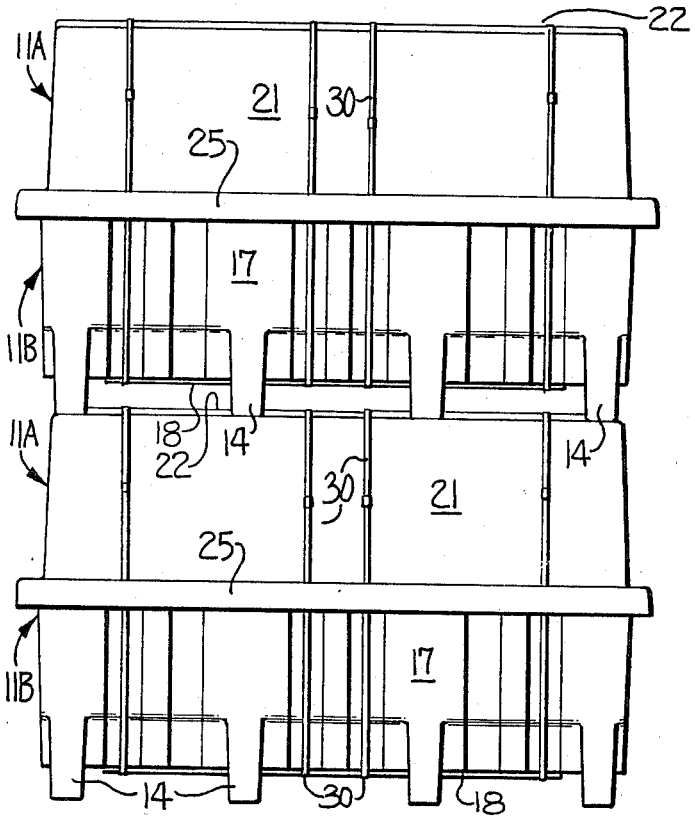
FIG. 7 is a side elevation view of a stack of packages.
Figure 8:
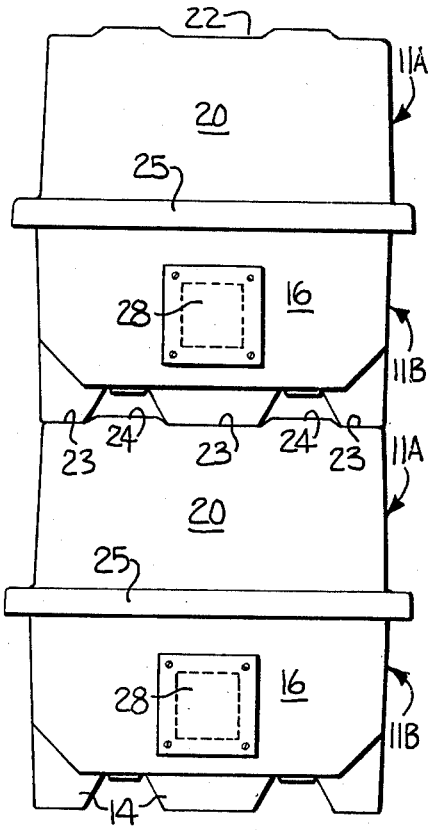
FIG. 8 is a front elevation view of the stack of packages shown in FIG. 7 and wherein the top member of the package positioned at the bottom of the stack includes recessed areas which receive the feet of the adjacent package stacked thereon.

Top member 11A of container 11 includes opposing pairs of side walls 21, end walls 20, and a top wall 22. The top wall 22 is preferably provided with recessed areas 23 (FIG. 1) in mirror image relation to the projecting members 14 in order to receive the projecting members of the bottom member 11B of a second container when a stack of containers is formed (FIG. 8). The recessed areas 23 form lateral anti-shift abutments 24 in the top member which inhibit lateral shifting of the containers in a stack. Also, the sidewall surfaces of the projecting members 14 and the corresponding sidewall surfaces of the lateral abutments 24 may be tapered so as to facilitate the positioning and stacking of the containers and to further protect against lateral shifting (See FIGS. 11 and 12). In order to protect against longitudinal shifting, raised portions in the form of stacking stops 32 (FIG. 13) are preferably provided on the top member 11A and positioned relative to the projecting members 14 of the bottom member 11B to abuttingly contact the same and effectively prevent any longitudinal shifting. The depth of the recessed areas 23 in the top member 11A is preferably dimensioned relative to the depth of the projecting members as well so as to retain the aforementioned forklift channels 15 even when a plurality of the containers are stacked (FIGS. 7 and 8), again to improve the handling characteristics of the container.

Figure 9:
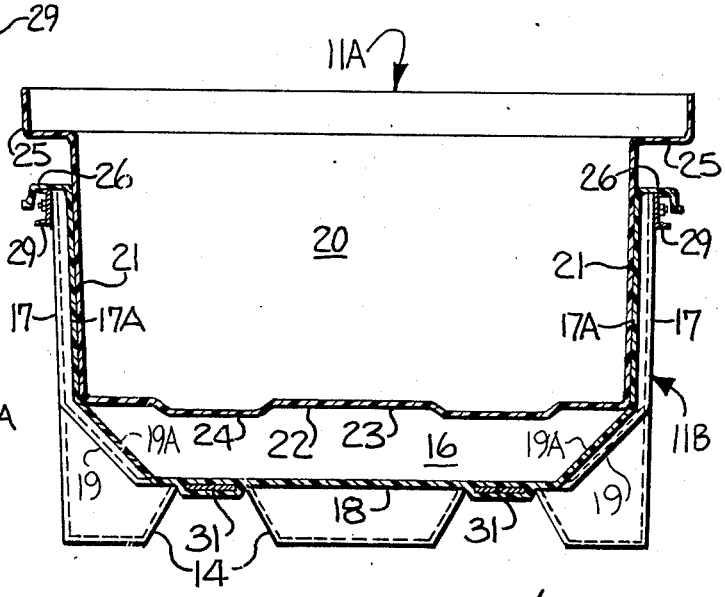
FIG. 9 is a sectional elevation view of the container in empty, nested form.

Top member 11A is preferably of a lesser vertical height than bottom member 11B so that it may be inverted and nestingly received in the bottom member for compact storage of the container 11 when not in use to facilitate both their storage in a warehouse as well as their transportation, when empty, to the point of origin (FIG. 9). For example, the container depicted in the drawings has a height of approximately 5 feet when assembled while it stands only slightly over 3 feet in height when in nested form.

Figure 3:
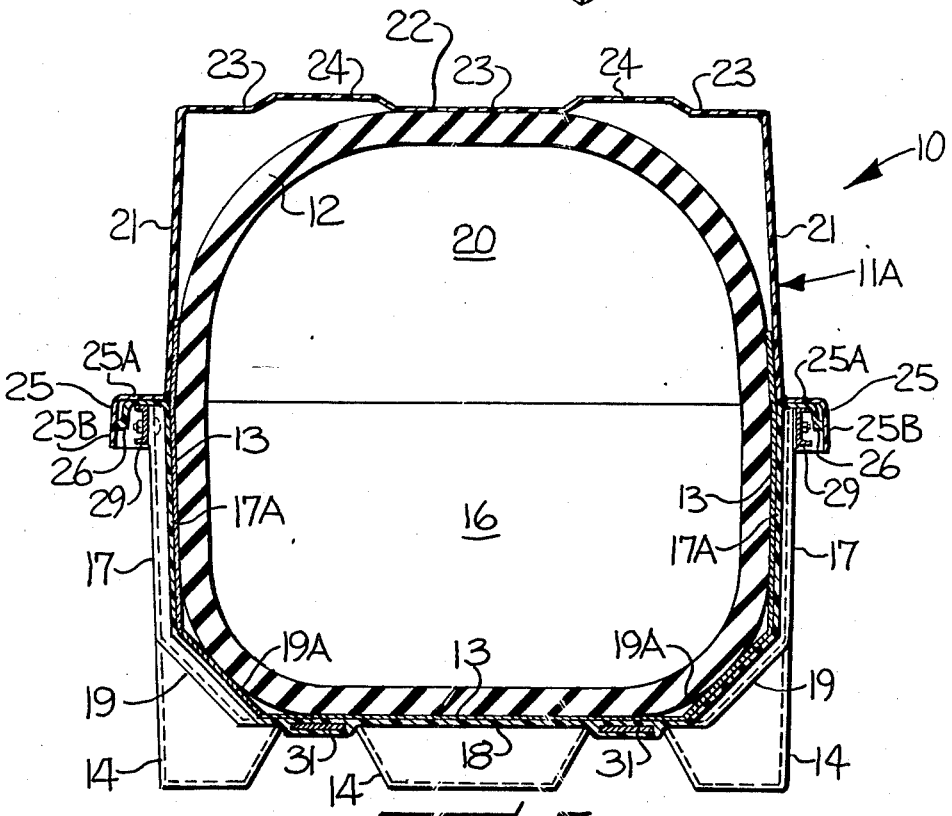
FIG. 3 is a cross-sectional view of the container and package taken along line 3—3 in FIG. 2.
Figure 10:
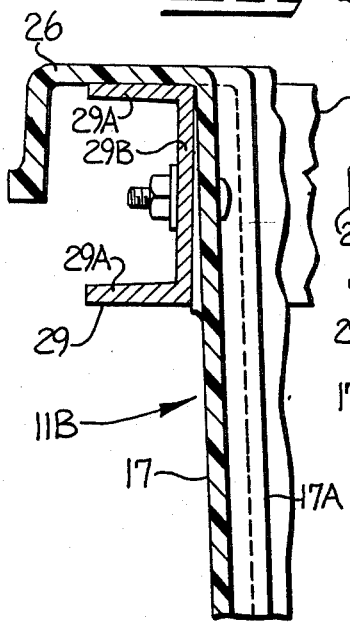
FIG. 10 is a view in cross section of the rim provided on the bottom member of said container and depicting a reinforcing frame having portions positioned underneath the rim.

Top member 11A and bottom member 11B are preferably equipped with peripheral rims 25 and 26 respectively. Each of the two rims is suitably configured and dimensioned so as to enter into cooperative engagement with the other. Rim 25 on the top member 11A preferably includes portions 25A (FIG. 3) extending outwardly from lower portions of the top member as well as downwardly extending portions 25B relative to the side walls 21 and end walls 20 of the top member 11a to provide a shroud that encompasses rim 26 of bottom member 11B when the container is assembled. In this manner, liquid penetration into the interior chamber of container 11 is avoided when, for example, substances are spilled on the container, or when the container is used for transoceanic shipping. In a similar vein, rim 26 of bottom member 11B preferably extends outwardly from upper portions of the bottom member 11B and includes portions 26A (FIG. 10) that lie in a plane perpendicular to the side and end walls of bottom member 11B and to the downwardly extending portions 25B of the rim 25 of the top member 11A. In this manner, portions of the lower rim will desirably engage inner surface portions of the upper rim 25B, as shown in FIG. 3, in sinuous, sealing relation to the rim 25 so as to effectively seal the container from any liquid penetration whatsoever. Moreover, an optional extruded gasket (not shown) may be placed on the ledge defined by the portions of the lower rim 26A in the preferred construction to provide an airtight seal along the rims. This is particularly desirable where the endless belt 12 is made of compounded rubber since ozone present at levels of several parts per million or solvent vapors in the air may adversely affect the belt. In a similar vein, the container should be opaque, and preferably molded of dark pigmented plastic since direct sunlight may also have a detrimental effect on these belts.

Figure 2:
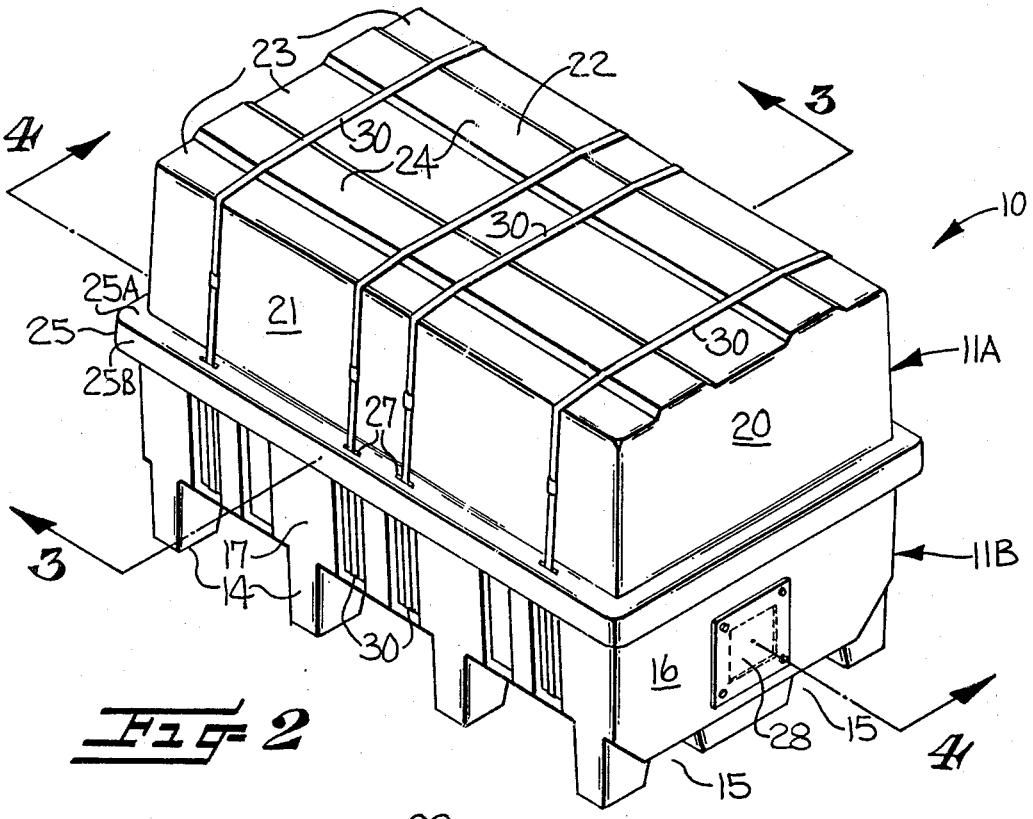
FIG. 2 is a perspective view of the assembled container and package.

The preferred form of the container or package includes a plurality of vertically arranged apertures 27 which extend through the upper rim 25 of the top member 11A and the lower rim 26 of the bottom member 11B at a plurality of similarly spaced locations along the respective rims (FIGS. 1 and 2). In this manner, strapping means 30 may be inserted through the apertures and fastened by conventional means to securely hold the top and bottom members together. Moreover, as shown in FIGS. 11 and 12, the combination of the preferred recessed areas 23 with strapping means 30 provides effective protection against longitudinal shifting as an alternative to the aforementioned stacking stops 32 since the strapping means will be spaced away from the recessed areas and can engage the feet of a second container stacked thereon. To this end, the apertures 27 in the rims hold the strapping means securely in position.

Where the container is used for transporting and storing endless belts of substantial weight and bulk as described above, a reinforcing frame 29 (FIG. 3) is preferably provided on upper regions of the bottom member 11B and is preferably secured thereto through the use of bolts, for example. The frame 29 is preferably positioned so that portions thereof underlie the lower rim 26 of the bottom member 11B to provide reinforcement for the rim as well. In addition, the lower rim serves to partially shroud the reinforcing frame from view in the preferred form as to improve the overall aesthetic characteristics of the container (see FIGS. 5 and 10). The frame may be formed from any suitable starting material including conventional channel bar sections which may be welded together to form a unitary frame that surrounds the upper regions of the bottom member. The legs 29A (FIG. 10) of the preferred channel members forming the frame 29 are preferably arranged in a horizontal plane so that they extend outwardly from side walls 17 and end wall 16 of bottom member 11B while the web portions 29B of the channel members will lie parallel thereto. Absent the use of reinforcing frame 29, the unreinforced upper regions of the bottom member 11B might burst under the weight of the endless belt which it supports. For example, a typical rubber belt of the type used in preshrinking units in the textile industry has a thickness of about $2\frac{5}{8}$ inches, a machine width which corresponds to the lengthwise orientation of the container of 76 inches, and an interior circumference of approximately 13 feet. This size belt weighs in excess of 1,200 pounds. Moreover, the container is preferably adapted to support additional units in a stack so that it must be capable of supporting at least an additional 1,500 pounds (if only one package is to be stacked thereon). Through the use of reinforcing frame 29, as well as the corrugated wall construction described above, the thickness of the container walls may be reduced to approximately $\frac{3}{8}$ of an inch (as in the particular container depicted in the drawings) without significantly compromising its overall strength.

Figure 4:
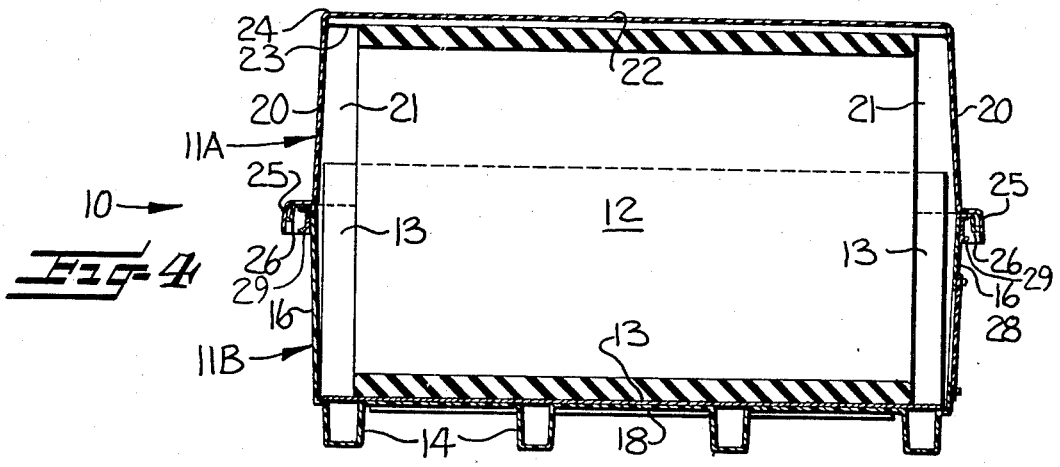
FIG. 4 is a cross-sectional view of the container and package taken along line 4—4 in FIG. 2.

A significant feature of the novel shipping container described herein is its ability to cooperate with a deformable endless belt of substantial bulk and weight to maintain the generally cylindrical configuration of the latter. As noted in the foregoing paragraph, compression shrinking blankets used in preshrinking units typically weigh in excess of 1,200 pounds (up to 1,400 pounds in an 83-inch machine width belt having a thickness of $2\frac{5}{8}$ inches). The container shown in the drawings can accommodate up to an 86 inch belt, but can be used for smaller width belts as well (FIG. 4). As these belts are fabricated entirely of rubber, they readily collapse if unsupported. In the event the belt collapses in the shipping container while in route or in storage, significant problems result. The first problem is derived from the readily deformable nature of the endless belt or blanket. That is, the collapsed belt assumes a kidney shape in cross section thereby exerting forces on the two outer loops of the resulting kidney which may permanently deform those areas. A similar type of deformation results if lower portions of the belt (i.e. at the lower corners) are unsupported since the belt tends to assume the shape of its container over time causing the formation of similar creases at the corners. If either form of permanent deformation occurs, any fabric fed through a preshrinking unit equipped with the blanket will be rendered useless with attendant losses in raw materials and productivity.

In packages constructed in accordance with the preferred form of the present invention, the damage resulting from the collapse of a belt is avoided. In this connection, the distance between the opposing side walls 17 of the bottom member 11B of the container 11, or portions of the side walls 17A if the corrugated structure is employed, should be determined in relation to the exterior diameter of the belt 12. Preferably, the resulting distance between the portions of the belt lying adjacent the side walls is slightly less than the exterior diameter of the belt 12 so as to columnize the opposed portions of the belt 12A (FIG. 3) to thereby maintain the substantially arcuate shape of the upper regions of the belt. For example, the container shown in the drawings has an interior effective width (between side wall portions 17A) of approximately 51 inches as compared to the exterior diameter of the belt of approximately 55⅛ inches. Moreover, in order to prevent the formation of creases in the lower regions of the belt, portions 19A of the interposed wall portions 19 (FIG. 3) contact the belt and provide support to the portions of the belt resting thereon as well as to the columnized belt portions extending vertically therefrom in an area where the belt might otherwise assume the shape of the corners in a conventional container (i.e. a right angle). In this fashion, the two primary sources of deformations are rendered harmless. Moreover, as shown in FIG. 3, the top member 11A of the container and package preferably applies a slight compressive force on the belt or blanket. Since the opposing sides of the belt are columnized by the action of the opposing side wall, and the interposed wall portions provide additional support for the corner regions as well as the columnized regions extending above the corners, the belt serves to augment the overall strength of the package beyond that achievable with the container alone when placed in a stack (FIGS. 7 and 8). Accordingly, the invention not only resolves a problem which had plagued the industry, but transforms the source of the problem (the bulky belt) into a positive force which enhances the overall qualities of the package.

In order to protect the face of the belt against contamination from dirt, for example, or to accommodate belts of varying outside diameters, a belt protective insert 13 may be provided (FIG. 1). The insert may be fabricated from any suitable material including plastic or corrugated liner board. Thickness of the insert(s) may be varied so that the effective interior width of the bottom member may be adjusted. In this manner, the same container may be used for transporting belts of various sizes. In any event the insert is preferably used to protect the face of the belt from dirt or other contamination. In order to further protect the face of the belt, the interior walls of the container should be smooth and free of sharp corners.

The foregoing discussion with regard to side walls 17 of bottom member 11B may apply to some extent to side walls 21 of top member 11A. Depending upon the relative depth of each of the constituent members of container 11, top member 11A may aid in providing support to the belt 12 in the regions of the belt described. In the embodiment shown in FIG. 3, these side walls do in fact provide some support. In order to facilitate packaging and removal of the belt prior to applying or following removal of the top member, however, the areas of primary support should reside in the bottom member. To this end, the belt protective insert 13 (FIGS. 1 and 3) may be used to effectively extend the height of the sidewalls of the bottom member 11B to ease the process of packaging. As shown in FIG. 3, portions of the insert may extend above the bottom member 11B. In this fashion, the side walls of the belt 12 will not extend into the rim area causing inadvertent damage to the belt when the top member 11A is applied.

According to the novel packaging method, which may be practiced with the novel container described herein, the loading as well as subsequent unloading of heavy deformable endless belts is greatly facilitated. Conventional crating for shipment of these belts, for example, has traditionally employed a planar lid. Consequently, the crate must be turned on its side and the belt rolled out of the crate. In the case of the rubber belts or blankets of the type described, substantial risks to employee safety are presented. In addition, the surface onto which the belt is removed must be free of all dirt and debris to avoid contamination to the face of the belt which might later damage the fabric fed through the preshrinking unit. If the belt has in fact collapsed within the container, a difficult and time consuming procedure is required to return the belt to its cylindrical shape. In addition, the risk of damage from splinters or the like is also increased.

Figure 1A:
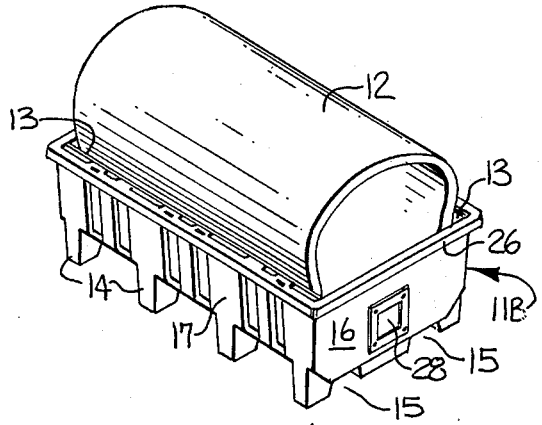
FIG. 1A is a perspective view of the belt positioned in the container in accordance with the present method.
Figure 1B:
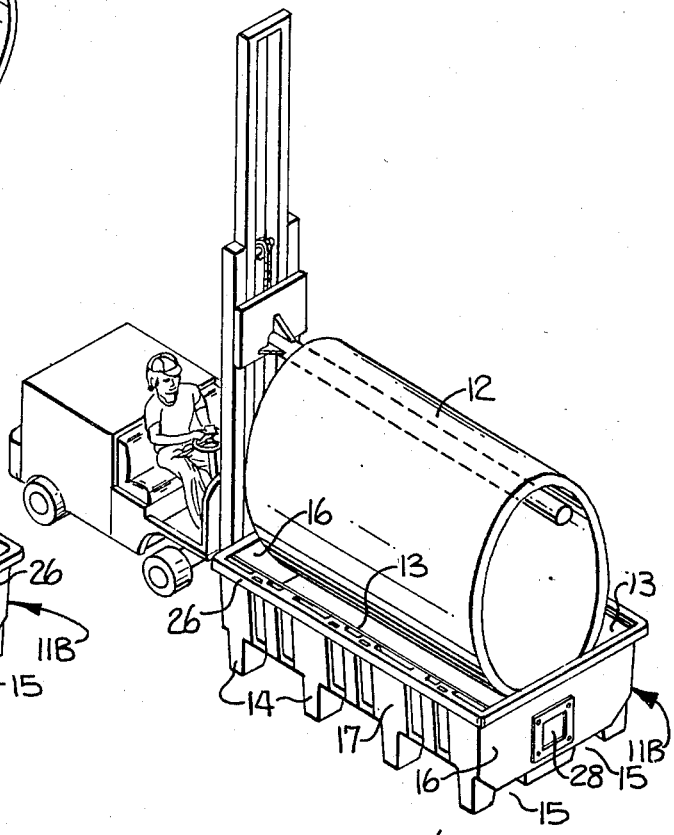
FIG. 1B is a perspective view depicting the handling of the endless belt with a mandrel on a forklift truck for placing the belt in a shipping container or removing the same according to the novel method described herein.

The novel packaging method, which avoids the aforementioned problems, consists of providing a shipping container which includes top and bottom members having relatively large, hollow cavities which cooperate to form a hollow closed chamber. A mandrel is positioned within an open end of the belt whereupon the belt is lifted and positioned within the bottom member of the container (FIGS. 1A and 1B) while leaving upper regions of the opposed open ends of the belt exposed for subsequent removal or reinsertion of the mandrel. The lower regions of the belt which lie adjacent to lower corner areas of the bottom member are supported in a fashion which columnizes opposed lower portions of the belt alongside the opposing side walls of the bottom member to maintain the arcuate shape of the belt in the upper regions thereof. To this end, the shipping container described above may be desirably and advantageously employed to practice the method. Once the belt is positioned in the bottom member as described, the mandrel is then removed and the top member is placed in engaging relation to the bottom member to form a package. In order to remove the belt, the user need only remove the top member to expose the readily accessible upper regions of the belt. A mandrel may then be inserted and the belt removed (FIG. 1B). While a mandrel mounted on a forklift truck is depicted in the drawings, any suitable arrangement may be used including a hoist and mandrel arrangement.

As can be readily seen from the foregoing description of the preferred embodiments of the invention, the above described shipping container, package, and packaging method provide significant advantages over those heretofore known in the art. While the drawings and specification serve to describe the preferred embodiments only, they should not be utilized for purposes of unduly limiting the scope of the present invention, which scope is defined solely by the appended claims.

That which is claimed is:

1. A generally rectangularly shaped container for facilitating the shipment, storage and removal of heavy, bulky and deformable endless belts of a generally cylindrical configuration and of a type used in the textile industry for shrinking fabrics, said container comprising top and bottom members cooperatively engaging each other to form a hollow closed chamber, said top and bottom members each being integrally molded of relatively thick plastic material, said top member comprising opposing pairs of side and end walls and a top wall, said bottom member comprising opposing pairs of side and end walls, a bottom wall, and interposed wall portions extending at an angle between said bottom and side walls and interconnecting the same, said interposed wall portions being adapted to serve for preventing deformation of a belt by providing stabilizing underlying support for the belt portions resting thereon and belt portions extending upwardly therefrom for maintaining the generally cylindrical configuration of the belt so as to prevent the formation of creases in the belt, and a plurality of spaced apart projecting members extending downwardly from said bottom wall, said interposed wall portions and said adjacent side walls, said projecting members defining supporting feet for the container, and wherein said projecting members are arranged so as to define forklift channels therebetween adapted to receive the forks of a forklift truck for facilitating the lifting and transporting of the container.

2. A container according to claim 1, wherein said top member has a lesser vertical height than said bottom member, and said top member is dimensioned so as to be nestingly received when inverted within said bottom member so as to facilitate transportation or storage of the empty container in a compact condition.

3. A container according to claim 1, wherein said top wall of said top member is provided with recessed areas therein adapted to receive the feet of an adjacent stacked container and wherein a plurality of stacking stops are provided in association with at least one of said recessed areas, such stops being adapted for abuttingly contacting the feet of an adjacent container stacked thereon to prevent longitudinal sliding movement thereof.

4. A container according to claim 1 wherein at least one of said end walls of the bottom member includes an inspection window and a releasably secured closure, said window and closure being adapted for providing access to said chamber for facilitating visual examination of goods positioned within said container.

5. A container according to claim 1, wherein an integral lower rim extends outwardly from upper portions of said bottom member and an integral upper rim extends outwardly from lower portions of said top member, and wherein said upper rim extends outwardly further than said lower rim and substantially overlies the same and substantially shrouds the lower rim on the bottom member from view.

6. A container according to claim 5, wherein portions of the lower rim extending outwardly from said bottom member are closely positioned to inner surface portions of said upper rim extending outwardly and downwardly from said top member, whereby the respective rims are arranged in sinuous, sealing relationship relative to each other to aid in protecting a belt positioned in the container.

7. A container according to claim 5, wherein said upper rim on said top member and said lower rim on said bottom member include vertically arranged apertures extending therethrough at a plurality of similarly spaced locations along the respective rims, the apertures along one side of the container being similarly arranged as the apertures provided on the opposite side thereof, and strapping means extending through said apertures and interconnecting the top and bottom members to each other.

8. A container according to claim 5, including a reinforcing frame secured to and surrounding upper regions of said bottom member and wherein portions of said frame are positioned underneath and behind said lower rim on said bottom member, said frame serving for reinforcing said lower rim and upper portions of said bottom member when a belt is positioned in the container to avoid rupturing the upper regions of the bottom member resulting from the heavy weight of the belt.

9. A container according to claim 8, wherein said frame comprises channel members weldingly interconnected to each other and wherein the legs of the channel members lie in a horizontal plane and extend outwardly away from the side and end walls of the bottom member.

10. A container according to claim 7, wherein said top wall of said top member is provided with recessed areas therein, which areas are spanned by said strapping means so that the strapping means is spaced away from the bottom of such recesses, and wherein said recesses are adapted to receive the feet of an adjacent container stacked thereon, and wherein said strapping means serves to provide adjacent abutment means for said feet of the adjacent container for preventing longitudinal sliding movement of the stacked container thereon.

11. A generally rectangularly shaped container for facilitating the shipment, storage and removal of heavy, bulky and deformable endless belts of a generally cylindrical configuration and of a type used in the textile industry for shrinking fabrics, said container comprising top and bottom members cooperatively engaging each other to form a hollow closed chamber, a reinforcing frame secured to and surrounding upper regions of said bottom member for strengthening said upper region, said top and bottom members each being integrally molded of relatively thick plastic material, said top member comprising opposing pairs of side and end walls and a top wall, said bottom member comprising opposing pairs of side and end walls, a bottom wall, and interposed wall portions extending at an angle between said bottom and side walls and interconnecting the same, said interposed wall portions being adapted to serve for preventing deformation of a belt by providing stabilizing underlying support for the belt portions resting thereon and belt portions extending upwardly therefrom for maintaining the generally cylindrical configuration of the belt so as to prevent the formation of creases in the belt, a plurality of spaced apart projecting members extending downwardly from said bottom wall, said interposed wall portions and said adjacent side walls, said projecting members defining supporting feet for the container, and wherein said projecting members are arranged so as to define forklift channels therebetween adapted to receive the forks of a forklift truck for facilitating the lifting and transporting of the container, and strapping means interconnecting the top and bottom members to provide a unitary container.

12. A package comprising a generally rectangularly shaped container and an endless belt positioned therein, said container comprising top and bottom members each being integrally molded of plastic material and cooperatively engaging the other to form a closed chamber containing the endless belt therein, said top member of said container comprising opposing pairs of side and end walls and a top wall, said bottom member comprising opposing pairs of side and end walls, a bottom wall, and interposed wall portions extending at an angle between said bottom and side walls and interconnecting the same, and a plurality of spaced apart projecting members extending downwardly from said bottom wall, said interposed wall portions and said adjacent side walls, said projecting members defining supporting feet for the container and being arranged so as to define forklift channels therebetween adapted for receiving the forks of a forklift truck for facilitating the lifting and transporting of the package, and wherein said belt comprises a heavy bulky and deformable endless belt having a generally cylindrical configuration and having portions thereof resting on said interposed wall portions with other portions of the belt extending vertically therefrom in a substantially straight line in adjacent relation to portions of said opposing pair of side walls of said bottom member, the distance between said portions of the opposing pair of side walls in said bottom member being such as to cause the opposing portions of the belt extending upwardly from said interposed wall portions to be at a distance apart that is less than the diameter of the belt to columnize said opposing portions of the belt whereby said interposed wall portions and said endless belt portions collectively cooperate with the upper regions of the belt thereabove to prevent collapsing of the belt which would result in the attendant formation of permanent creases which render the belt unfit for use for its intended purposes.

13. A package according to claim 12, wherein the top wall of said top member of said container is provided with recessed areas therein adapted to receive the feet of an adjacent stacked package and wherein a plurality of stacking stops are provided in association with at least one of said recessed areas, such stops being adapted for abuttingly contacting the feet of an adjacent stacked package to prevent longitudinal sliding movement thereof.

14. A package according to claim 12 wherein interior portions of the top wall of said top member contact adjacent upper portions of the belt positioned in the container and apply relatively light compressive forces thereto whereby said belt aids in distributing and supporting the weight of a similar package stacked thereon.

15. A package according to claim 12 wherein at least one of said end walls of the bottom member of said container includes an inspection window and a releasably secured closure, said window and closure being adapted for providing access to said chamber for facilitating visual examination of the belt positioned within said container.

16. A shipping package according to claim 12 further comprising a belt protective insert in said bottom member interposed between said belt and the adjacent side walls, bottom wall and interposed wall portions of said bottom member for protecting the belt against deformations.

17. A package according to claim 12, wherein an integral lower rim extends outwardly from upper portions of the bottom member of said container and an integral upper rim extends outwardly from lower portions of said top member of said container, and wherein said upper rim extends outwardly further than said lower rim and substantially overlies the same and substantially shrouds the lower rim on the bottom member from view.

18. A package according to claim 17, wherein portions of the lower rim extending outwardly from said bottom member are closely positioned to inner surface portions of said upper rim extending outwardly and downwardly from said top member, whereby the respective rims are arranged in sinuous, sealing relationship relative to each other to provide protection for said belt positioned in the container.

19. A package according to claim 17, wherein said upper rim on said top member and said lower rim on said bottom member include vertically arranged apertures extending therethrough at a plurality of spaced locations along the respective rims, the apertures along one side of the container of said package being similarly arranged as the apertures provided on the opposite side thereof, and strapping means extending through said apertures and interconnecting the top and bottom members of said container to each other to form a unitary package.

20. A package according to claim 17, including a reinforcing frame secured to and surrounding upper regions of said bottom member and wherein portions of said frame are positioned underneath and behind said lower rim on said bottom member, said frame serving for reinforcing said lower rim and upper portions of said bottom member to avoid rupturing the upper regions of the bottom member of said container resulting from the heavy weight of the belt positioned therein and the weight of adjacent packages stacked thereon.

21. A package according to claim 16 wherein portions of said insert extend above said bottom member to facilitate positioning of said belt in the bottom member as well as to thereafter facilitate the guiding of the top member into engagement with said bottom member in forming the package.

22. A package according to claim 16 further comprising a flexible gasket interposed between said portions of the lower rim and said inner surface portions of said upper rim so as to provide effective sealing protection against the elements for said belt positioned in the container.

23. A package according to claim 19, wherein said top wall of said top member is provided with recessed areas therein, which areas are spanned by said strapping means so that the strapping means is spaced away from the bottom of such recesses, and wherein said recesses are adapted to receive the feet of an adjacent package stacked thereon, and wherein said strapping means serves to provide adjacent abutment means for said feet of the adjacent package for preventing longitudinal sliding movement of the stacked package thereon.

24. A package according to claim 20, wherein said frame comprises channel members weldingly interconnected to each other and wherein the legs of the channel members lie in a horizontal plane and extend outwardly away from the side and end walls of the bottom member of said container.

25. A stack of packages, each of said packages comprising a generally rectangularly shaped container having an endless belt positioned therein, each of said containers in the stack comprising top and bottom members each being integrally molded of plastic material and cooperatively engaging the other to form a closed chamber containing the endless belt therein, said top member of each of said containers comprising opposing pairs of side and end walls and a top wall, said bottom member of each of said containers comprising opposing pairs of side and end walls, a bottom wall, and interposed wall portions extending at an angle between said bottom and side walls and interconnecting the same, and a plurality of spaced apart projecting members extending downwardly from said bottom wall, said interposed wall portions and said adjacent side walls, said projecting members defining supporting feet for the respective container in the stack and being arranged so as to define forklift channels therebetween adapted for receiving the forks of a forklift truck for facilitating the lifting and transporting of the packages in the stack, and wherein each of said belts positioned in each of said containers comprises a heavy, bulky and deformable endless belt having a generally cylindrical configuration and having portions thereof resting on said respective interposed wall portions with other portions of the belt extending vertically therefrom in a substantially straight line in adjacent relation to portions of said opposing pair of side walls of said bottom member, the distance between said portions of the opposing pair of side walls in said bottom member being such as to cause the opposing portions of the belt extending upwardly from said interposed wall portions to be at a distance apart that is less than the diameter of the belt to columnize said opposing portions of the belt and wherein interior portions of the top wall of the top member in each of said containers contact adjacent upper portions of the belt positioned in the respective container so as to apply slightly compressive forces thereto so that the belt aids in distributing and supporting the weight of overlying packages in the stack and wherein said interposed wall portions and said endless belt portions in each package collectively cooperate with the respective upper regions of the belt thereabove to prevent collapsing of the belt within each of the containers which would result in the attendant formation of permanent creases which render the belt unfit for use for its intended purposes.

26. A stack of packages according to claim 25, wherein the top wall of said top member of each of said containers in the stack is provided with recessed areas therein adapted to receive the feet of an adjacent stacked package and wherein a plurality of stacking stops are provided within at least one of said recessed areas, which stops are adapted for abuttingly contacting the feet of an adjacent stacked package to prevent longitudinal sliding movement thereof in the stack.

27. A stack of packages according to claim 25, wherein each of the containers in the stack includes an integral lower rim extending outwardly from upper portions of the bottom member of said containers and an integral upper rim extending outwardly from lower portions of said top member of each of said containers, and wherein each respective upper rim extends outwardly further than the corresponding lower rim and substantially overlies the same and substantially shrouds the corresponding lower rim on the bottom member from view.

28. A stack of packages according to claim 27, wherein said upper rim on said top member and said lower rim on said bottom member of each of said containers include vertically arranged apertures extending therethrough at a plurality of spaced locations along the respective rims, the apertures along one side of each of the containers being similarly arranged as the apertures provided on the respective opposite side thereof, and strapping means associated with each of said containers extending through said apertures respectively and interconnecting the top and bottom members of each of said containers to each other to form a stack of discrete unitary packages.

29. A stack of packages according to claim 27, wherein each of said containers includes a reinforcing frame secured to and surrounding upper regions of said bottom member of each of said containers and wherein portions of said frame are positioned underneath and behind said respective lower rim on said bottom member of each of said containers, said frame serving for reinforcing said respective lower rim and upper portions of said bottom member of each of said containers to avoid rupturing the upper regions of the bottom member resulting from the heavy weight of the belt positioned therein and the weight of adjacent packages stacked thereon.

30. A stack of packages according to claim 28, wherein said top wall of said top member of each of said containers is provided with recessed areas therein, which areas are spanned by said strapping means so that the strapping means is spaced away from the bottom of such recesses, and wherein said recesses are adapted to receive the feet of an adjacent package stacked thereon, and wherein said strapping means serves to provide adjacent abutment means for said feet of an adjacent package in the stack for preventing longitudinal sliding movement of the stacked package thereon.

31. A stack of packages according to claim 29, wherein said frame comprises channel members weldingly interconnected to each other and wherein the legs of the channel members lie in a horizontal plane and extend outwardly away from the side and end walls of the bottom member of each of said containers.

* * * * *